United States Patent [19]

Komatsu et al.

[11] 4,341,142

[45] Jul. 27, 1982

[54] MUSIC BOX

[75] Inventors: Fumito Komatsu, Shiojiri; Kenzi Muramatsu, Okaya, both of Japan

[73] Assignee: Kabushiki Kaisha Sankyo Seiki Seisakusho, Shimosuwa, Japan

[21] Appl. No.: 93,657

[22] Filed: Nov. 13, 1979

[30] Foreign Application Priority Data

Nov. 17, 1978 [JP] Japan ..... 53-158998

[51] Int. Cl.[3] ..... G10F 1/06

[52] U.S. Cl. ..... 84/95 R; 74/130

[58] Field of Search ..... 84/95 R, 95 C; 74/130; 185/43

[56] References Cited

U.S. PATENT DOCUMENTS

| | | | |
|---|---|---|---|
| 697,754 | 4/1902 | Sharps et al. | 185/43 |
| 864,038 | 8/1907 | Simon | 185/43 |
| 1,309,510 | 7/1919 | Davidson | 74/130 |
| 1,769,587 | 7/1930 | Luense | 185/43 |
| 2,430,600 | 11/1947 | Booth | 74/130 |
| 2,599,948 | 6/1952 | Shvetz | 84/95 C |
| 2,806,397 | 9/1957 | Nichols | 84/95 C |

FOREIGN PATENT DOCUMENTS

| | | | |
|---|---|---|---|
| 577296 | 5/1933 | Fed. Rep. of Germany | 84/95 R |

*Primary Examiner*—Monroe H. Hayes

*Attorney, Agent, or Firm*—James C. Wray

[57] ABSTRACT

This invention relates to a music box designed to be suitably mountable on a rocking chair or such, and more particularly it relates to an improvement in the mechanism for accumulating the drum-driving spring force in such music box.

7 Claims, 7 Drawing Figures

MUSIC BOX

BACKGROUND OF THE INVENTION

In a music box designed to fit on a rocking chair or other like object, there is used a mechanism for winding up the drum-driving spring by making use of the movement of the chair, but such conventional mechanism is complicated and not easy to maintain.

An object of this invention is to provide a music box designed to be suitably adaptable on a rocking chair or such, said music box being mechanically so improved that the drum-driving spring can be wound up positively and free of failure by a simple mechanism.

Other and further objects, features and advantages of the invention will appear more fully from the following description of the invention.

BRIEF DESCRIPTION OF THE DRAWINGS

In the accompanying drawings.

DETAILED DESCRIPTION OF THE INVENTION

Figure 1:
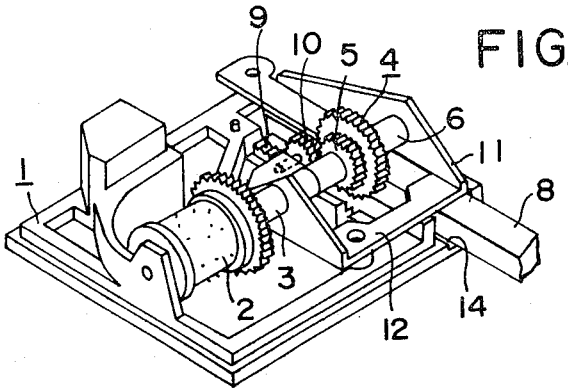
FIG. 1 is a general perspective view of the internal makeup of the music box according to this invention.
Figure 2:
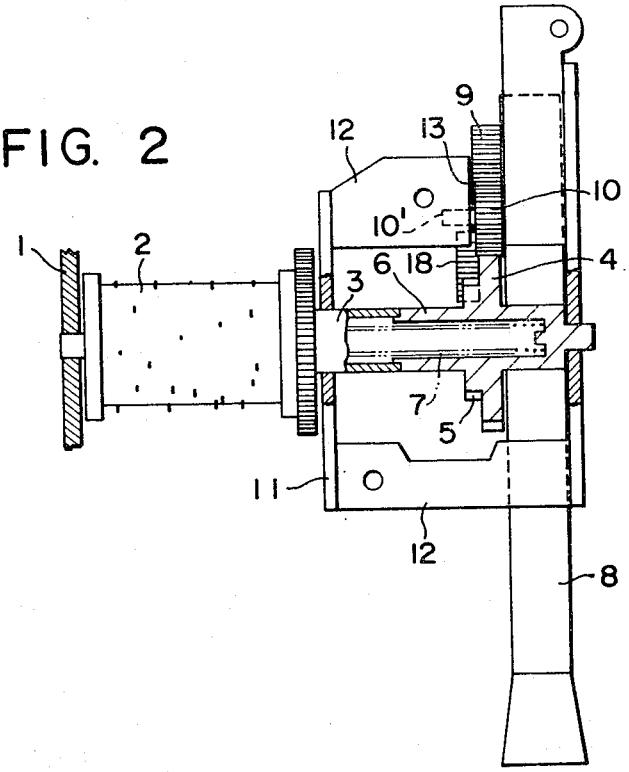
FIG. 2 is a partially cutout frontal view of the principal parts of the music box.
Figure 3:
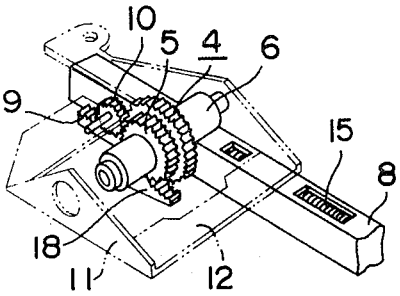
FIG. 3 is a partial perspective view thereof.

The invention is now described in detail by way of an embodiment thereof as illustrated in the accompanying drawings. Reference numeral 1 in the drawings indicates the base of the music box of this invention, and 2 designates a drum mounted on said base, said drum being connected to a governor (not shown) and adapted with vibratory reeds in a known way.

The drum shaft 3 of the drum 2 is hollow, and is axially and loosely connected to a hollow gear shaft 6 which has mounted thereon two starting gears 4, 5. Both drum shaft 3 and gear shaft 6 are connected to the respective ends of a drum-driving torsion spring 7 fitted in the hollow portions of said both shafts so that when the gear shaft 6 is turned by the operation described later, said spring 7 is twisted to accumulate the rotational force for the drum 2.

Numeral 8 refers to a rank bar slidably supported on the base and having a length such that the rear end thereof extends out longitudinally from the base, said rack bar 8 having mounted at a side of one end rack teeth 9 which mesh with intermediate gear 10 to intermittently drive gear 4.

Figure 4:
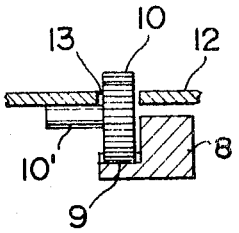
FIG. 4 is a sectional view of the intermediate gearing.
Figure 5:
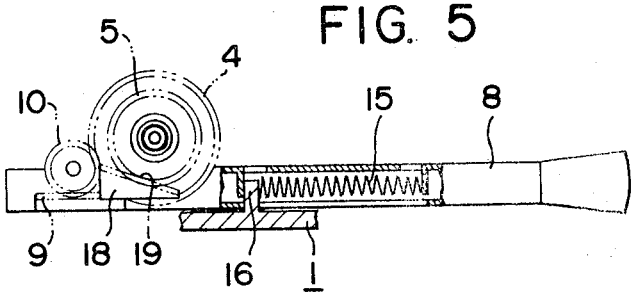
FIG. 5 is a side view of the rack assembly.

As supporting means for said intermediate gear 10, there is provided a cutout 13 in an adaptor plate 12 for the bearing 11 secured to the base for pivotally supporting said drum shaft 3 and gear shaft 6. Said cutout 13 extends parallel to the direction of movement of the rack bar 8 and has a width substantially equal to the wall thickness of said intermediate gear 10. The intermediate gear 10 is fitted into said cutout 13 in such a condition that said gear is meshed with the rack teeth 9 on the rack bar, thereby to support the intermediate gear 10 so that it won't fall sidewise. For preventing accidental removal of the intermediate gear 10 from said cutout 13, a short shaft portion 10' is provided on said gear 10 so that said shaft portion is rollable in contact with the underside of the adaptor plate 12 (see FIG. 4).

The rack bar 8 is slidably supported in a guide channel 14 formed by the upperside of the base and the underside of said adaptor plate 12 and also has therein an axial hollow portion in which a spring 15 is compressedly inserted, with one end of said spring being fixed to the rack bar while the other end is secured to a base side spring catch 16 disposed projectedly in said hollow portion, whereby the rack bar is always urged to move in one direction.

A stopper member 18 slidably supported in a guide channel 7 is provided in operative association with the other starting gear 5. Said stopper member 18 is wedge-shaped on its side and has rack teeth 19 on its slant portion, said rack teeth 19 being meshed with said starting gear 5.

For adapting the thus constructed music box to, for example, an arcuate leg portion of a rocking chair, said music box is mounted vertically so that the lower end of the rack bar will project out from the underside of said leg portion.

Now, the operation of this music box is described. FIG. 6(A) shows a condition where the rack bar 8 contacts with and is pushed up by the floor surface in accordance with chair movement. The spring 15 is compressed by this push-up of the rack bar while the intermediate gear 10 is moved upwardly while keeping its engagement with the rack bar 8. This causes disengagement of the intermediate gear 10 from the starting gear 4, thus inhibiting any wind-up of the torsion spring 7. On the other hand, the stopper member 18 descends under its own weight to engage with the starting gear 5 to lock it against turning.

Figure 6B:
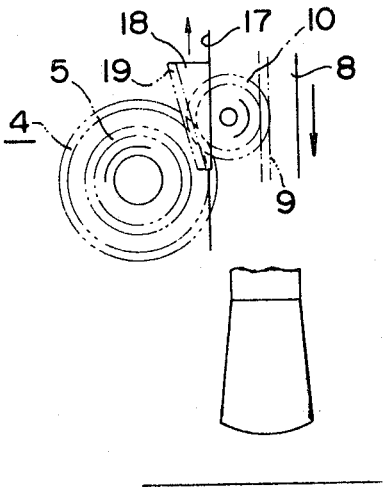
FIGS. 6(A) and (B) are schematic drawings for illustrating the operating conditions.
Figure 6A:
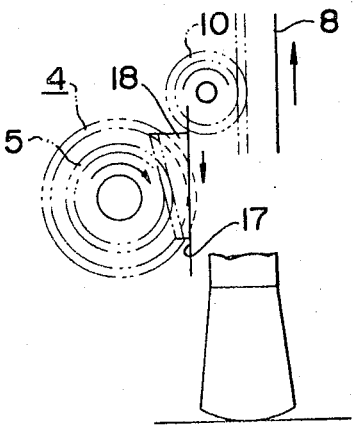

FIG. 6(B) shows a condition where the rack bar 8 pushed up under the condition of FIG. 6(A) is released from the floor surface in accordance with further chair movement and is again forced downwardly by the restorative force of the compressed spring 15.

With descent of the rack bar 8, the intermediate gear 10 which has been forced upwardly is now brought into engagement with the starting gear 4, causing the other starting gear 5 to also turn integrally in the direction of arrow, whereby the stopper member 18 which has been engaged with the starting gear 5 is released therefrom to allow wind-up of the torsion spring 7.

The drum 2 is now turned under the accumulated force of the torsion spring 7 to play music in a known way.

The turn of the drum is effected continuously in either mode of operations shown in FIG. 6(A) and FIG. 6(B) as long as the accumulated force remains in the torsion spring 7, and hence the role of the stopper member 18 in the condition of FIG. 6(A) is to prevent return of the torsion spring 7 to allow turning of the drum in one direction.

What is claimed is:

1. A rocking chair music box mechanism comprising a base for mounting on a rocking chair, a drum pivotally mounted on a base, a spring connected to the drum, a starting gear connected to the spring, whereby the spring is adapted to accumulate a turning force relative to the drum and starting gear, a rack bar slidably supported on the base, elastic means connected to the base and to the rack bar to urge the rack bar to make a return movement in one direction, an intermediate gear movably mounted on the base and operatively connected to said rack bar and engagable and disengagable with the starting gear according to movement of the rack bar, whereby when said rack bar is moved in said one direction by said elastic means, said rack bar moves the intermediate gear into engagement with the starting gear and imparts rotational movement to said intermediate gear, which imparts rotational movement to said starting gear to thereby accumulate turning force in said spring, a stopper member movably mounted on the base, said stopper being operatively connected to the starting gear in such a manner that when the rack bar rotates the intermediate gear and the intermediate gear rotates the starting gear, the stopper is moved out of operative stopping connection with the starting gear, and whereby when the starting gear is turned in an opposite direction said stopper member moves on the base into operative stopping connection with the starting gear, whereby the rack means and intermediate gear tend to rotate the starting gear in one direction and whereby the stopper tends to prevent rotation of the starting gear in an opposite direction.

2. A music box mechanism as claimed in claim 1, wherein movement of the stopper member into engagement with said starting gear is effected by its own weight.

3. A music box mechanism as claimed in claim 1, wherein the stopper member is wedge-shaped and has on its surface a rack teeth engageable with said starting gear.

4. A music box mechanism as claimed in claim 1, wherein the starting gear is of a double-geared structure, with one gear thereof being arranged meshable with the stopper and the other being arranged meshable with the intermediate gear.

5. A music box mechanism as claimed in claim 1, wherein a short shaft portion is provided on a side of the intermediate gear.

6. The music box mechanism of claim 1 further comprising a hollow drum shaft on which the drum is mounted, and a hollow gear shaft on which the starting gear is mounted, the hollow drum shaft and the hollow gear shaft being axially and loosely connected, the spring being fitted in hollow portions of the hollow drum shaft and the hollow gear shaft, and the drum shaft and gear shaft being connected to respective ends of the spring.

7. The music box mechanism of claim 1 wherein the base is mounted on a bottom of a rocking chair and the rack bar extends downward beyond a rocker of the rocking chair, wherein the elastic means tends to drive the rack bar downward from the rocker.

* * * * *